US005929883A

United States Patent [19]

Gunther et al.

[11] Patent Number: 5,929,883

[45] Date of Patent: Jul. 27, 1999

[54] PRINTING SYSTEM WITH SINGLE ON/OFF CONTROL VALVE FOR PERIODIC INK REPLENISHMENT OF INKJET PRINTHEAD

[75] Inventors: Max S. Gunther, La Jolla, Calif.; Ignacio Olazabal, Sant Cugat del Vallès, Spain; Mark E. Young, Santa Rosa, Calif.; Elizabeth Zapata, Barcelona, Spain; Joseph E. Scheffelin, Poway, Calif.; David S. Hunt, San Diego, Calif.; Alfred U. Zepeda, San Marcos, Calif.

[73] Assignee: Hewlett-Packard Company, Palo Alto, Calif.

[21] Appl. No.: 08/810,840

[22] Filed: Mar. 3, 1997

[51] Int. Cl.[6] ..... B41J 2/175

[52] U.S. Cl. ..... 347/85

[58] Field of Search ..... 347/7, 85, 86, 347/87

[56] References Cited

U.S. PATENT DOCUMENTS

| | | | |
|---|---|---|---|
| 3,930,258 | 12/1975 | Dick et al. | 346/75 |
| 4,223,323 | 9/1980 | Bader et al. | 347/85 |
| 4,412,232 | 10/1983 | Weber et al. | 347/86 |
| 4,475,116 | 10/1984 | Sicking et al. | 347/86 |
| 4,500,895 | 2/1985 | Buck et al. | 347/87 |
| 4,714,937 | 12/1987 | Kaplinsky | 347/86 |
| 4,831,389 | 5/1989 | Chan | 347/86 |
| 4,833,491 | 5/1989 | Rezanka | 347/43 |
| 4,929,963 | 5/1990 | Balazar | 347/89 |
| 4,959,667 | 9/1990 | Kaplinsky | 347/87 |
| 4,967,207 | 10/1990 | Ruder | 347/7 |
| 4,968,998 | 11/1990 | Allen | 347/7 |
| 4,970,528 | 11/1990 | Beaufort et al. | 346/25 |
| 5,121,132 | 6/1992 | Pan et al. | 347/87 |
| 5,126,767 | 6/1992 | Asai | 347/86 |
| 5,136,305 | 8/1992 | Ims | 347/7 |
| 5,280,300 | 1/1994 | Fong et al. | 347/87 |
| 5,329,294 | 7/1994 | Ontawar et al. | 397/87 |
| 5,359,353 | 10/1994 | Hunt et al. | 347/86 |
| 5,367,320 | 11/1994 | Erickson | 347/7 |
| 5,367,328 | 11/1994 | Erickson | 347/7 |
| 5,369,429 | 11/1994 | Erickson | 347/7 |
| 5,650,811 | 7/1997 | Seccombe et al. | 347/85 |

FOREIGN PATENT DOCUMENTS

| | | | |
|---|---|---|---|
| 0 237 787 A3 | 2/1987 | European Pat. Off. . | |
| 0 519 664 A2 | 6/1992 | European Pat. Off. . | |
| 0536980 A2 | 4/1993 | European Pat. Off. . | |
| 93 00 133 U | 1/1993 | Germany . | |
| 61-12347 | 1/1986 | Japan | B41J 3/04 |

OTHER PUBLICATIONS

Patent Abstracts of Japan, published by the European Patent Office, Publication Number: 60248355, Publication Date: Sep. 12, 1985.

*Primary Examiner*—N. Le
*Assistant Examiner*—Anh T. N. Vo
*Attorney, Agent, or Firm*—David S. Romney

[57] ABSTRACT

An inkjet printing system provides an on/off valve adapted for periodic engagement with an inlet port on a print cartridge mounted in a carriage. The valve is connected to an ink supply which is located off the carriage. As the ink reservoir in the print cartridge is slowly depleted during operation of the printing system, a mechanism periodically moves the valve from a first passive position separated from the print cartridge to a second active position engaged with the inlet port of the print cartridge in order to allow replenishment of the ink reservoir in the print cartridge without removing the print cartridge from the carriage.

22 Claims, 16 Drawing Sheets

FIG. 6
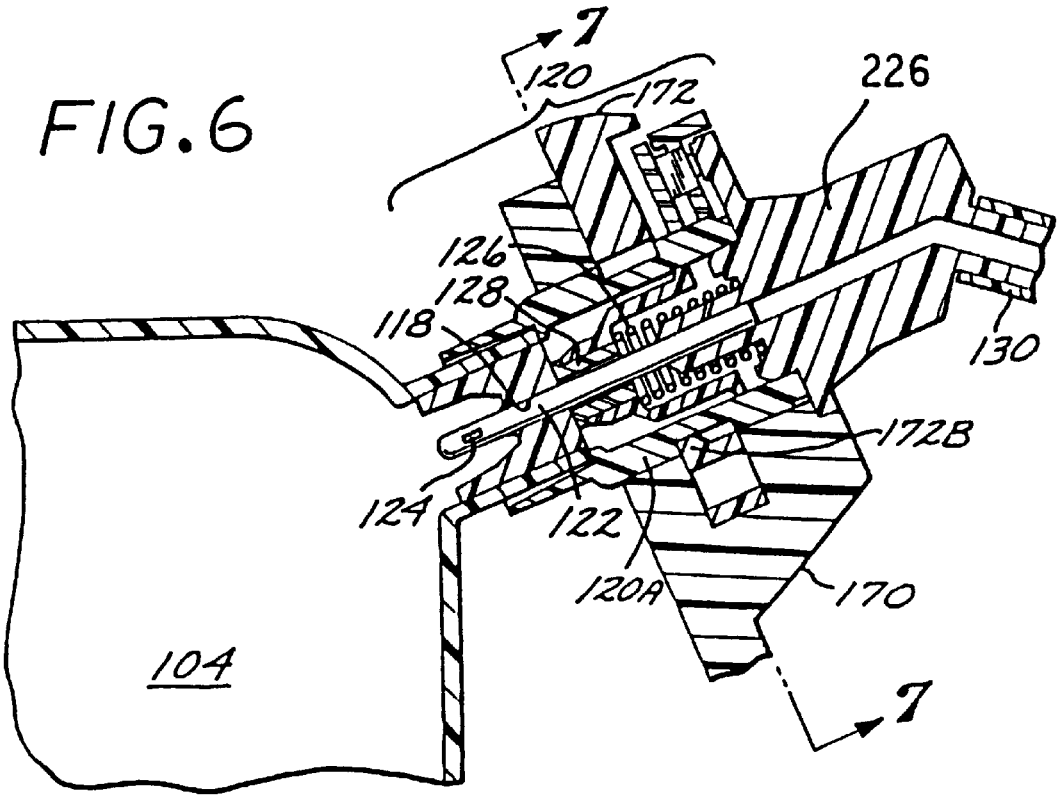
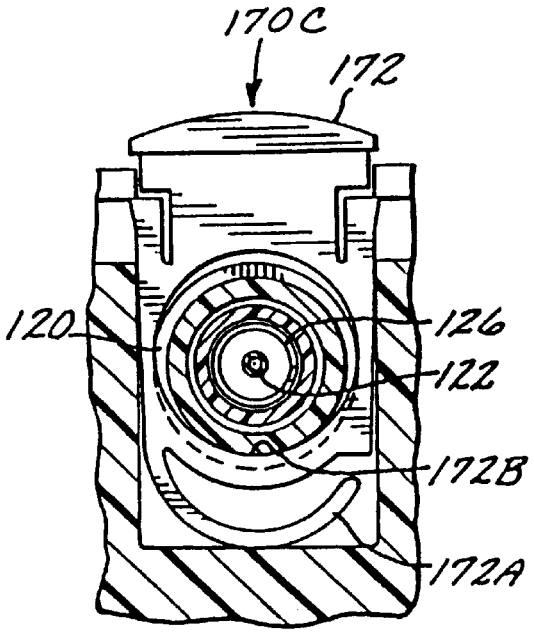
FIG. 7
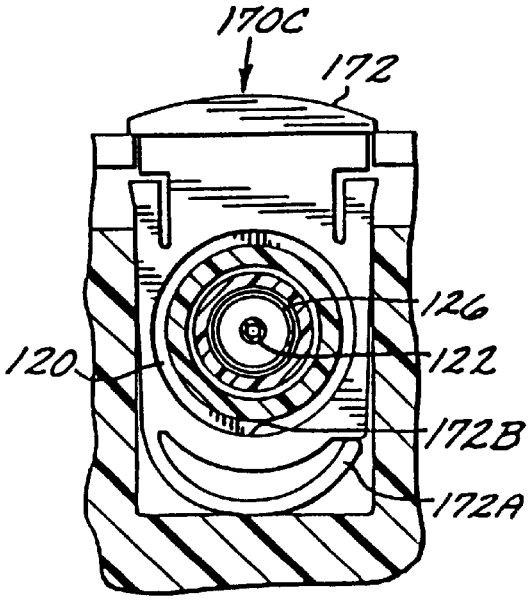
FIG. 8

PRINTING SYSTEM WITH SINGLE ON/OFF CONTROL VALVE FOR PERIODIC INK REPLENISHMENT OF INKJET PRINTHEAD

CROSS-REFERENCE TO RELATED APPLICATIONS

A previously filed co-pending commonly assigned application related this application is Ser. No. 08/454,975 filed May 31, 1995 by Joseph E. Scheffelin at al. (the "'975 application") entitled CONTINUOUS REFILL OF SPRING BAG RESERVOIR IN AN INK-JET SWATH PRINTER/PLOTTER, which is incorporated herein by reference.

Other more recent co-pending commonly assigned related applications are application Ser. No. 08/726,587, filed Oct. 7, 1996, entitled INKJET CARTRIDGE FILL PORT ADAPTOR, by Max S. Gunther, et al.; application Ser. No. 08/810,485, filed Mar. 3, 1997, entitled INKJET PRINTING WITH REPLACEABLE SET OF INK-RELATED COMPONENTS, by R. Becker, et al.; application Ser. No. 08/805,859, filed Mar. 3, 1997, entitled REPLACEABLE INK SUPPLY MODULE (BAG/BOX/TUB/VALVE) FOR REPLENISHMENT OF ON-CARRIAGE INKJET PRINTHEAD, by E. Zapata et al.; application Ser. No. 08/805,860, filed Mar. 3, 1997, entitled EFFICIENT ENCLOSURE SHAPE FOR NESTING TOGETHER A PLURALITY OF REPLACEABLE INK SUPPLY BAGS, by E. Coiner et al.; application Ser. No. 08/805,860, filed Mar. 3, 1997, entitled PRINTER APPARATUS FOR PERIODIC AUTOMATED CONNECTION OF INK SUPPLY VALVES WITH MULTIPLE INKJET PRINTHEADS, by I. Olazabal et al.; and application Ser. No. 08/806,749, filed Mar. 3, 1997, entitled VARIABLE PRESSURE CONTROL FOR INK REPLENISHMENT, by M. Young et al., all of which are incorporated herein by reference.

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER" which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotter has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced applications describe certain features of this new ink delivery system.

BRIEF SUMMARY OF THE INVENTION

This invention optimizes the performance of this new off-carriage, take-a-gulp ink delivery system. In this type of IDS, a pen cartridge that uses an internal spring to provide vacuum pressure is intermittently connected to an ink reservoir located off the scanning carriage axis. Starting with a "full" pen cartridge, the printer will print a variety of plots while monitoring the amount of ink used. After a specified amount of ink has been dispensed, the pen carriage is moved to a refill station for ink replenishment. In the refill station, a valve is engaged into the pen, thus connecting the ink reservoir to pen cartridge and opening a path for ink to flow freely. Using only the vacuum pressure present in the pen cartridge, ink is "pulled" into the pen from the reservoir.

An inkjet printing system provides an on/off valve adapted for periodic engagement with an inlet port on a printhead mounted in a carriage. The valve is connected to an ink supply which is located off the carriage. As the ink reservoir in the printhead is slowly depleted during operation of the printing system, a mechanism periodically moves the valve from a first passive position separated from the printhead to a second active position engaged with the inlet port of the printhead in order to allow replenishment of an ink reservoir in the print cartridge without removing the print cartridge from the carriage. The on/off valve acts as a single control valve which by itself provides the only required connection to the printhead to carry out the ink replenishment operation. Also the engagement of the on/off valve with the inlet port causes the on/off valve to move to an open position.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

DETAILED DESCRIPTION OF THE PREFERRED EMBODIMENT

Figure 1:
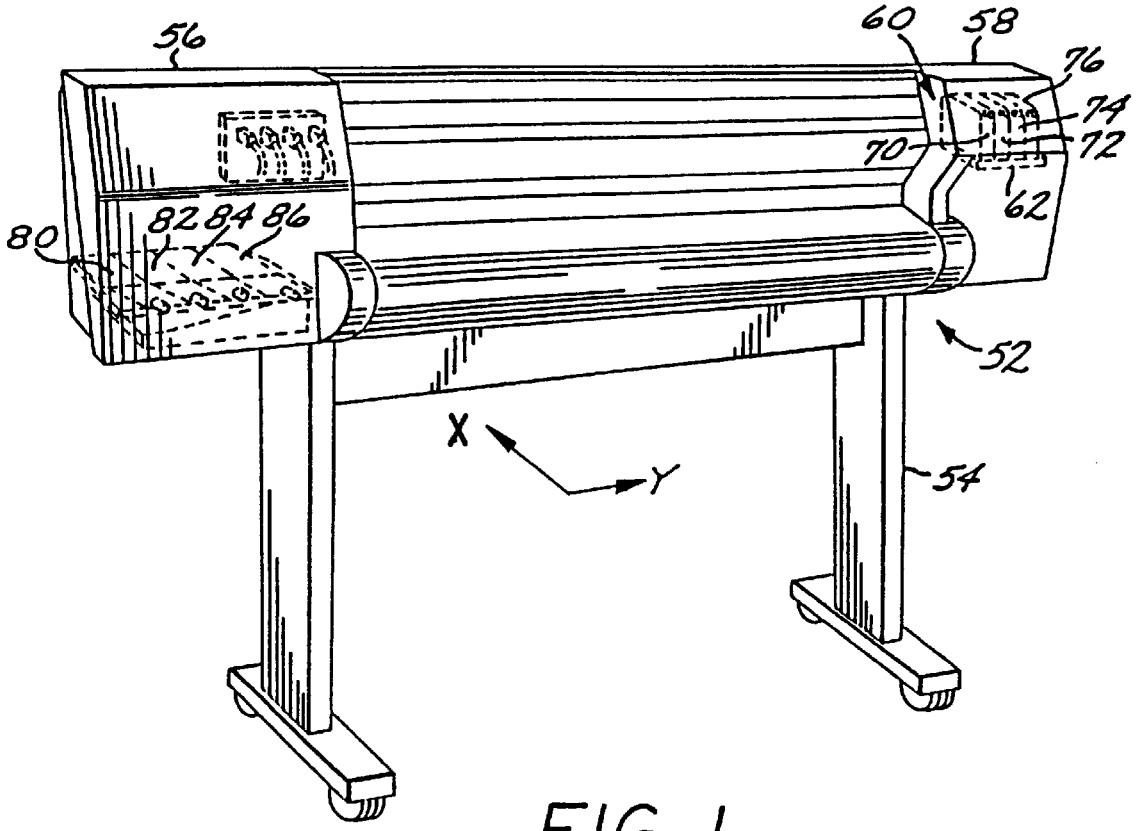
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage bar, shown in phantom under cover 58. A print medium such as paper is positioned along a media axis by a media axis drive mechanism (not shown). As is common in the art, the media drive axis is denoted as the 'x' axis and the carriage scan axis is denoted as the 'y' axis.

Figure 3:
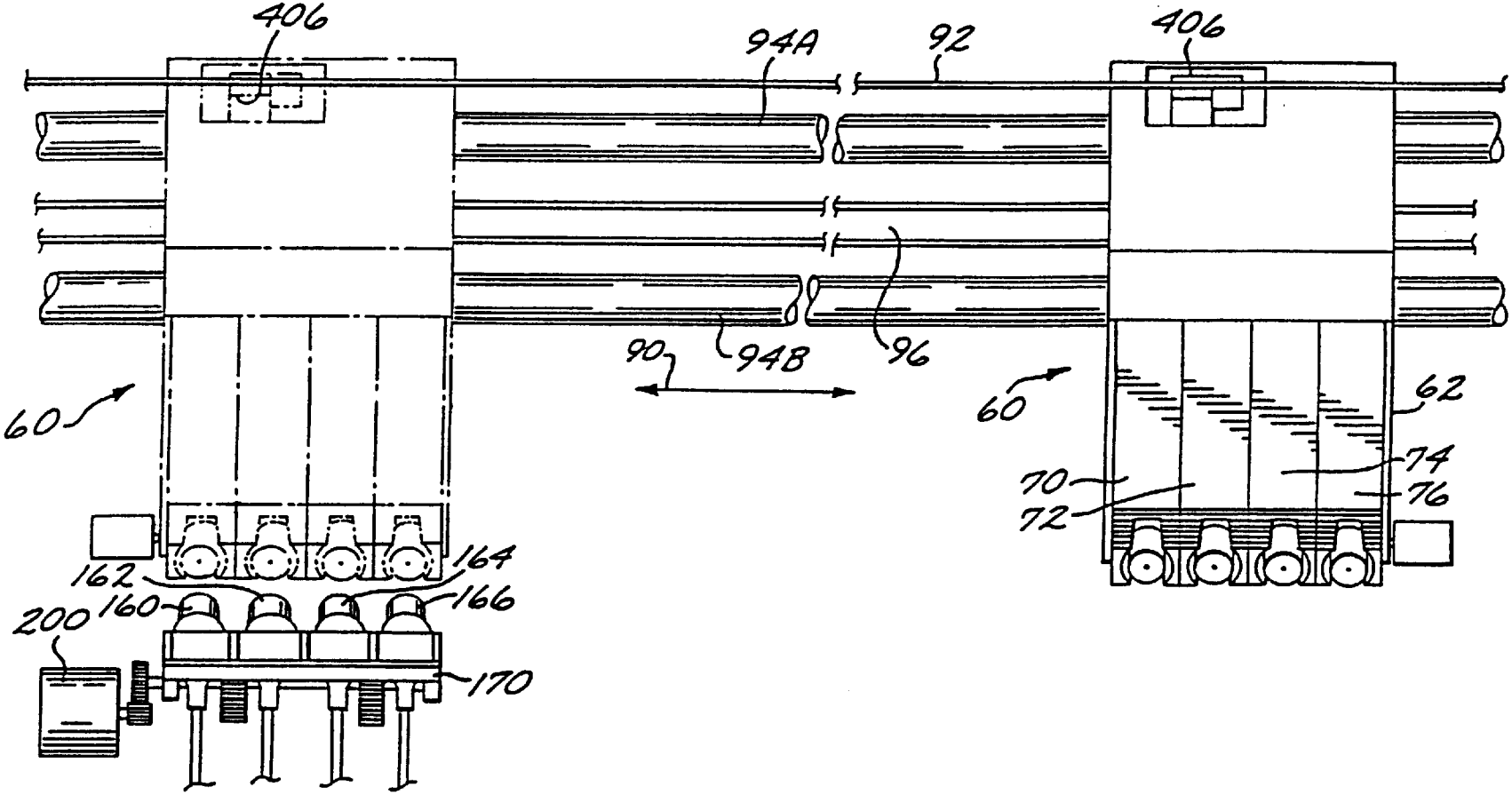
FIG. 3 is a top view showing the printer carriage and refill station.
Figure 4:
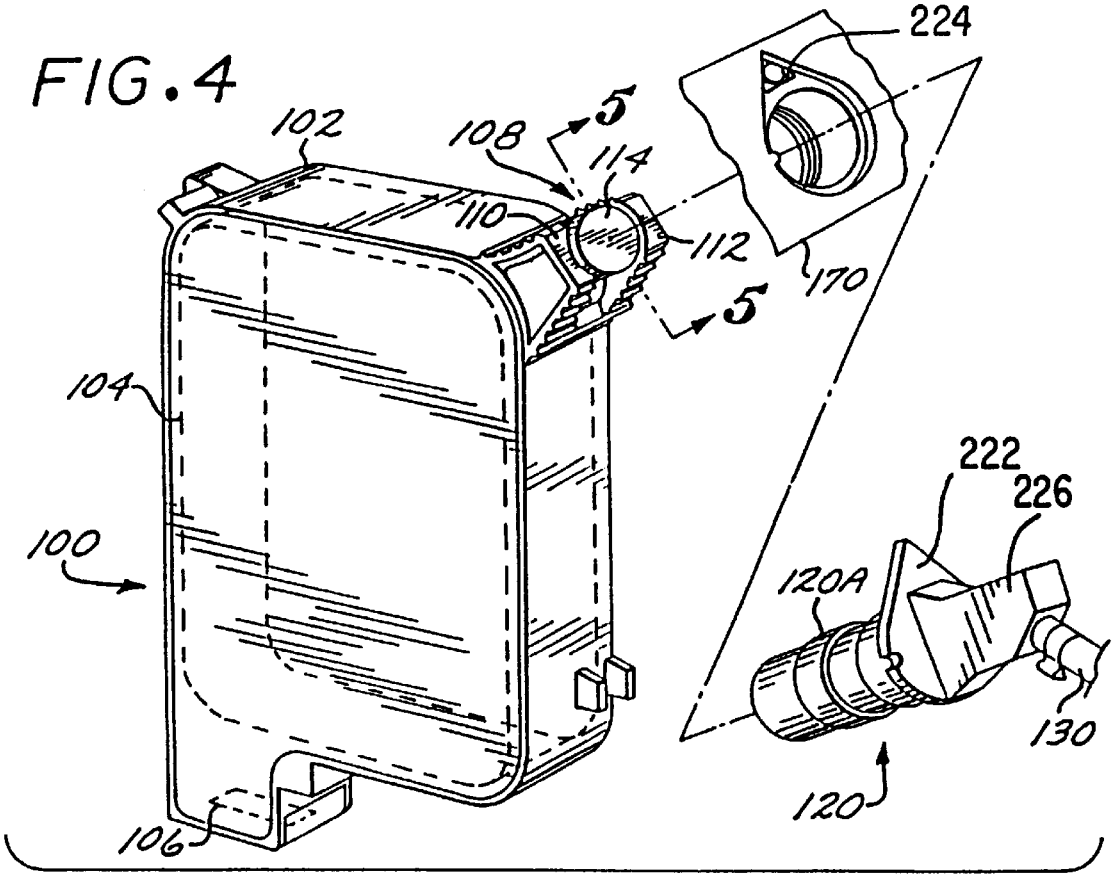
FIG. 4 is an isometric view of an ink-jet print cartridge usable in the system of FIG. 1, with a refill platform housing portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis in determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 15) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70, 72, 74, and 76 that store ink of different colors, e.g., yellow, cyan, magenta and black ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a head cleaner. The ink reservoir includes a bag holding 350 ml of ink, with a short tube and refill valve attached. Details of a ink reservoir bag structure suitable for the purpose are given in co-pending application Ser. No. 08/805,860, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a refill arm 170, also behind the left door, as will be described below. The print cartridge in this exemplary embodiment includes a 300-nozzle, 600 dpi printhead, with an orifice through which it is refilled. The head cleaner includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 5 ccs of ink of any color).

The '975 application describes a negative pressure, spring-bag print cartridge which in adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

Figure 5:
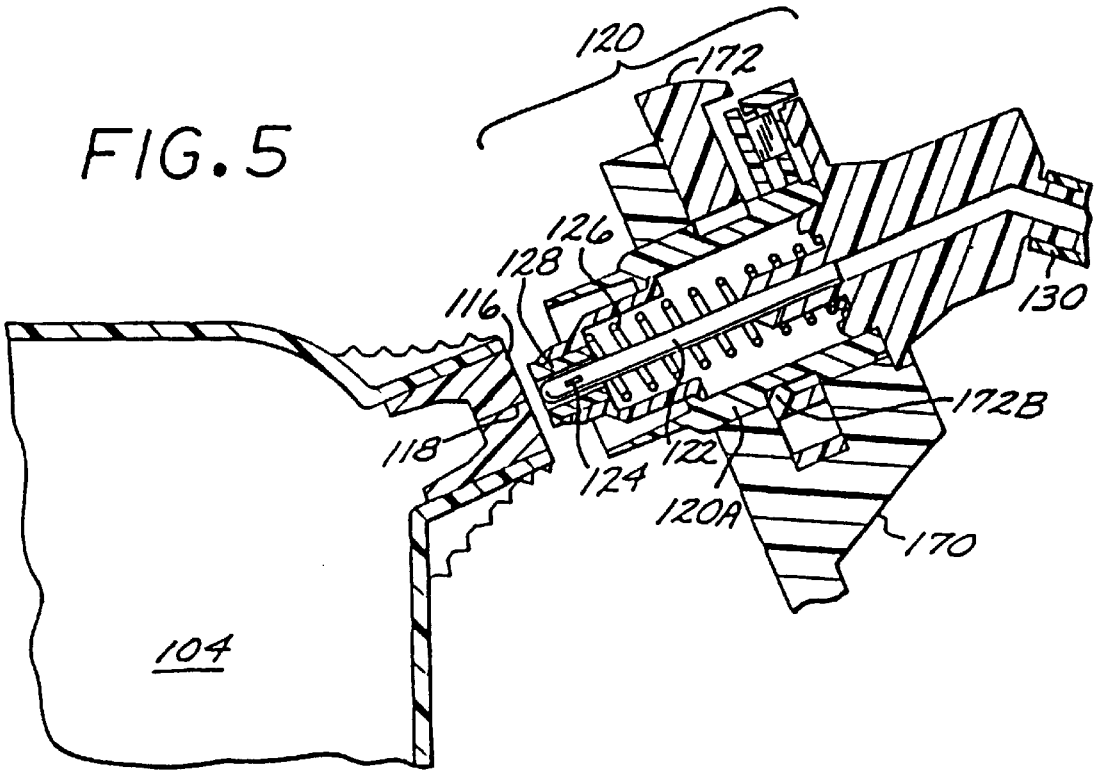
FIG. 5 is a cross-sectional view taken along line 5—5 of FIG. 4, showing the valve structure in a disengaged position relative to a refill port on the print cartridge.
Figure 9:
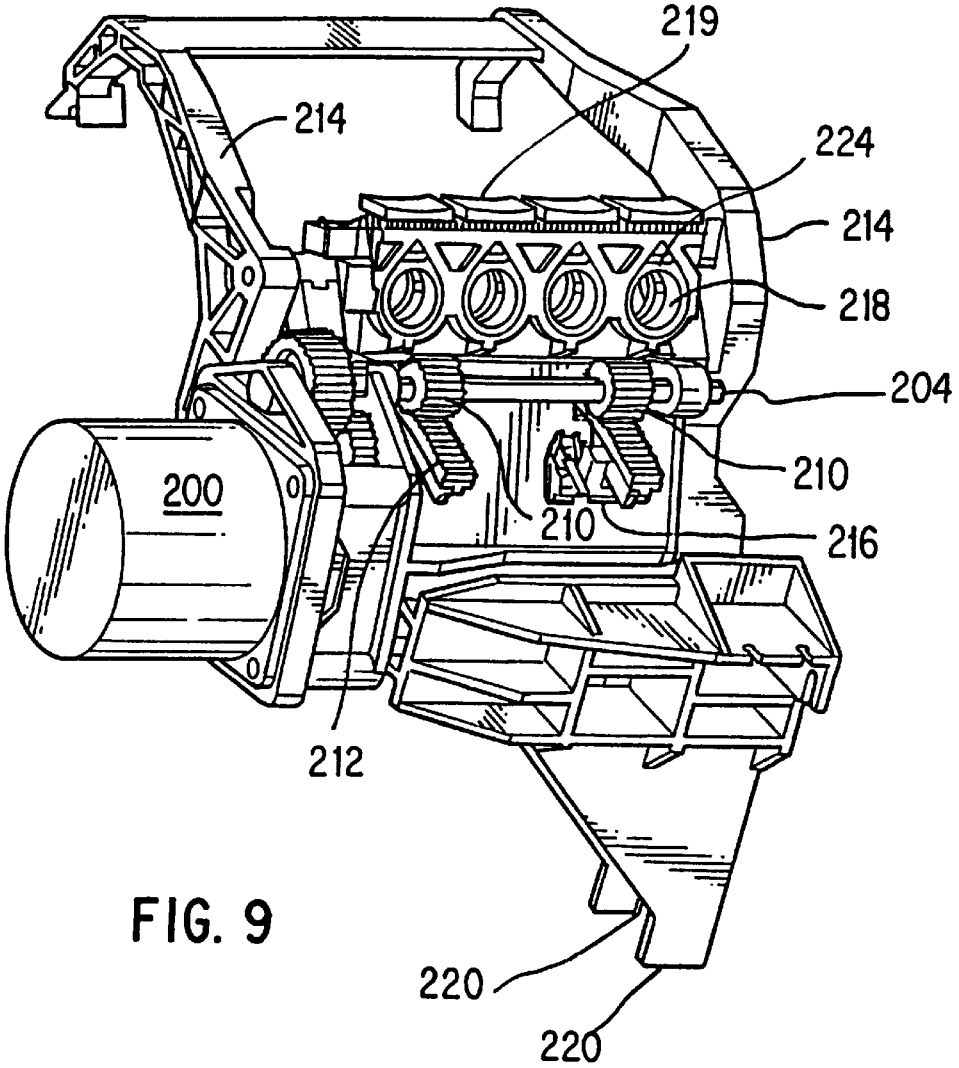
FIG. 9 is an enlarged view showing the mechanism for moving the valve structure, without any valves mounted thereon.

FIGS. 5–8 show additional detail of the grip 108. The grip includes two connectors 110, 112 on opposing sides of a cylindrical part 114 which communicates with the reservoir 104. The port is scaled by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 5 shows the valve structure 120 adjacent but not engaged with the port 114. FIG. 6 shows the valve structure 120 fully engaged with the port. As shown in FIG. 6, the structure 120 includes hollow needle 122 with a closed distal end, but with a plurality of openings 124 formed wherein adjacent the end. A sliding valve collar 128 tightly fits about the needle, and is biased by a spring 126 to a valve closed position shown in FIG. 5. When the structure 120 is forced against the port 116, the collar is pressed up the length of the needle, allowing the needle tip to slid into the port opening 118, as shown in FIG. 6. In this position, ink can flow through the needle openings 124 between the reservoir 104 and the tube 130. Thus, with the cartridge 100 connected to an off-carriage ink reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting an the collar 128. The opening 118 will close as well due to the elasticity of the material 116, thereby providing a self-sealing refill port for the print cartridge.

FIGS. 4–8 illustrate a locking structure 172 for releasably locking the valve 120 into the refill arm 170 at socket 174. The structure 172 has locking surfaces 172B (FIG. 5) which engage against the outer housing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application.

Figure 2:
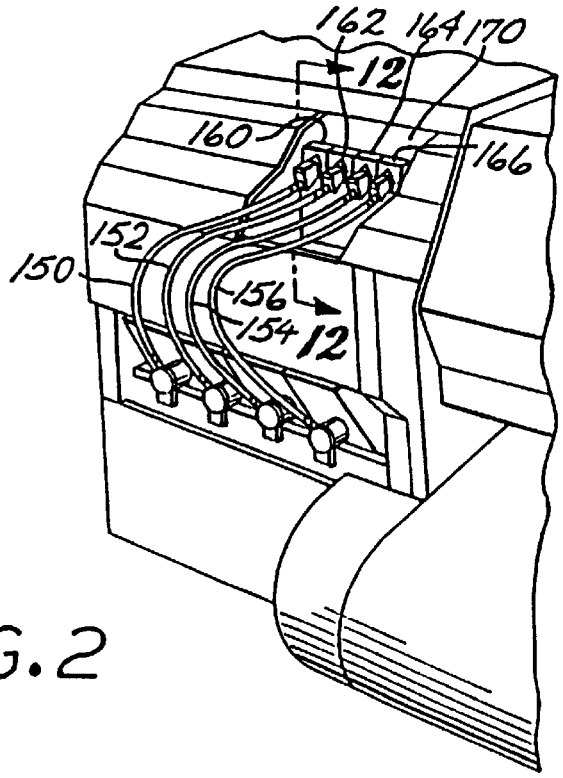
FIG. 2 is an enlarged view of a portion of the system of FIG. 1, showing the refill station.

In the exemplary system of FIG. 1, the refill platform 150 is in the left housing 56 of the printer 50 as shown in FIG. 2. The four off-carriage ink reservoirs 80–86 are supported on the platform 150. Short flexible tubes 152, 154, 156 and 158 connect between ports 80A–86A of corresponding reservoirs 80–86 and needle valve structures 160, 162, 164 ad 166 supported at a refill station housing 170. These needle valve structures each correspond to the valve structure 120 of FIGS. 4–8.

The refill platform 150 is an elevator that holds the four reservoirs and can be moved up and down.

Figure 13:
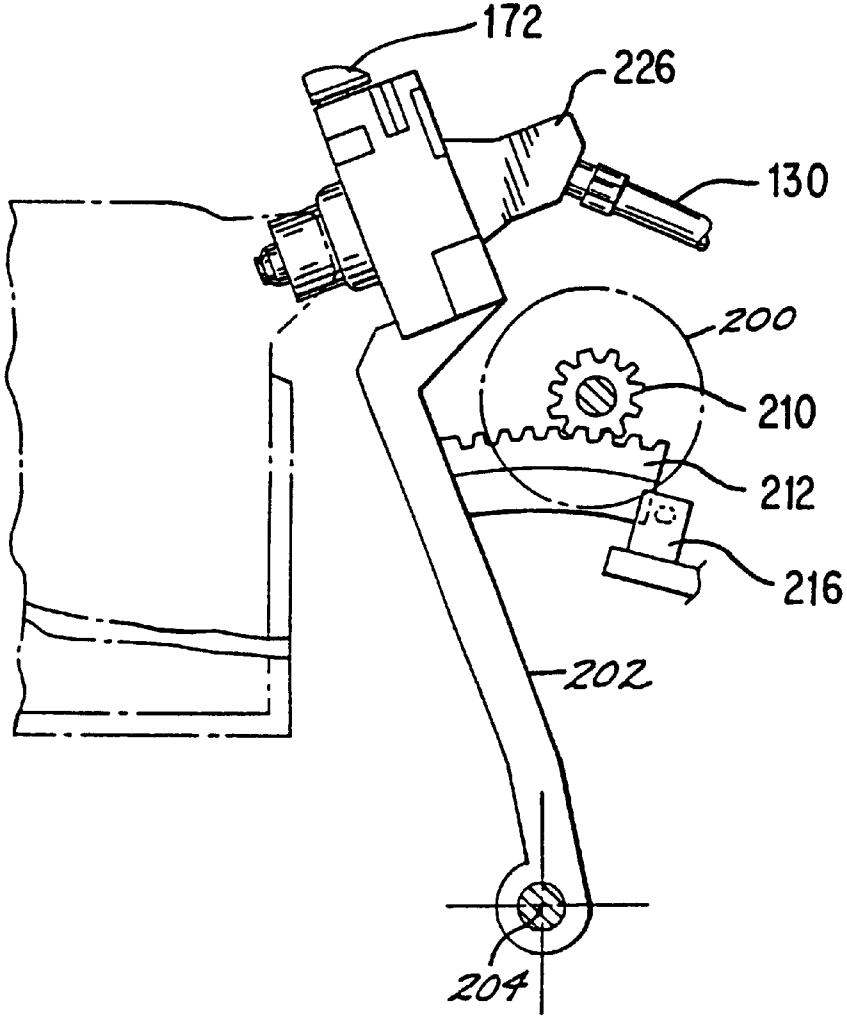
FIG. 13 is a detailed side view showing the mechanism for moving the valve structure in engaged position with a print cartridge.
Figure 12:
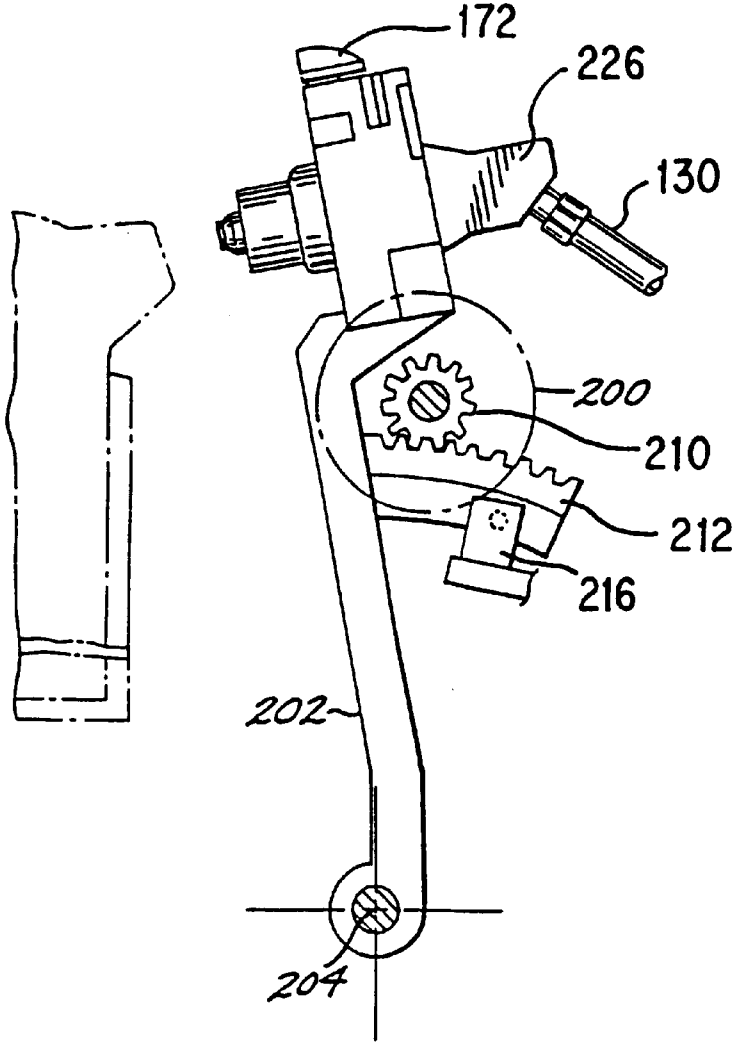
FIG. 12 is a detailed side view showing the mechanism for moving the valve structure in disengaged position with a print cartridge.

To perform a refill the carriage assembly 60 in moved to the refill station where the four off-carriage reservoirs 80–86 are connected to the corresponding print cartridges 70–76 via the shut-off valves 160–166. The connection of the reservoirs is accomplished by turning a stepper motor 200 that advances a lever 202 that rotates on axle 202 and on which the valve structure and refill station housing 170 are mounted, as shown in FIGS. 3 and 12–13. A system suitable for moving the valves into and out of engagement with the refill ports is more fully described in co-pending application Ser. No. 08/805,860, Attorney Docket No. 6096023, APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self regulating refill process where, as more ink is introduced into the print cartridge, the back pressure decreases to a point where the print cartridge cart no longer pull additional ink from the cartridge and the refill steps. The pressure at which the flow of ink stops is governed by the distance offsetting the print cartridge and the off-carriage reservoir. The farther below the print cartridge the reservoir is located, the greater the final pressure in the print cartridge and the lower the resulting volume of ink in the print cartridge internal reservoir.

Figure 16:
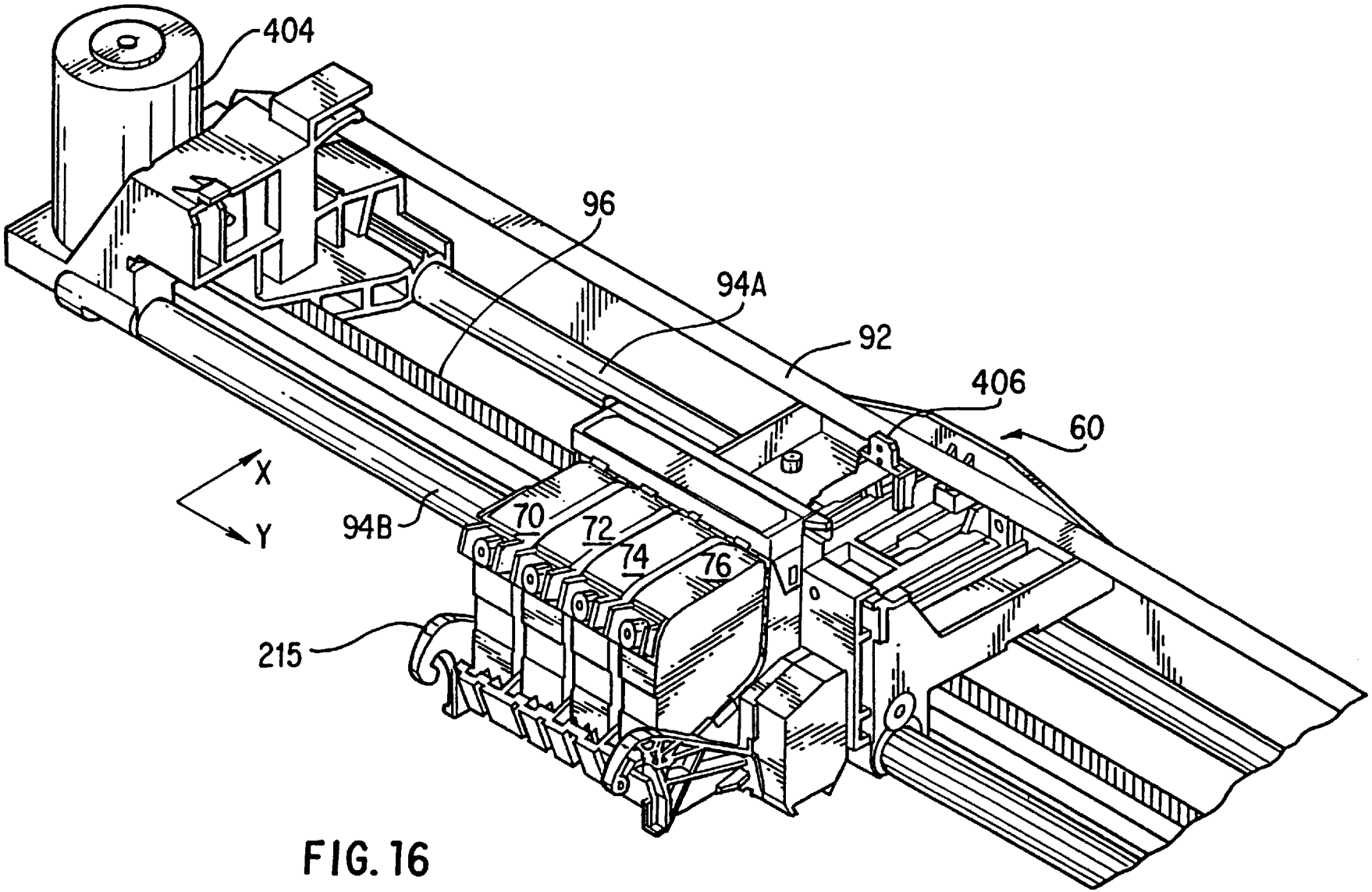
FIG. 16 is an isometric view of a carriage moving across a print zone.
Figure 17:
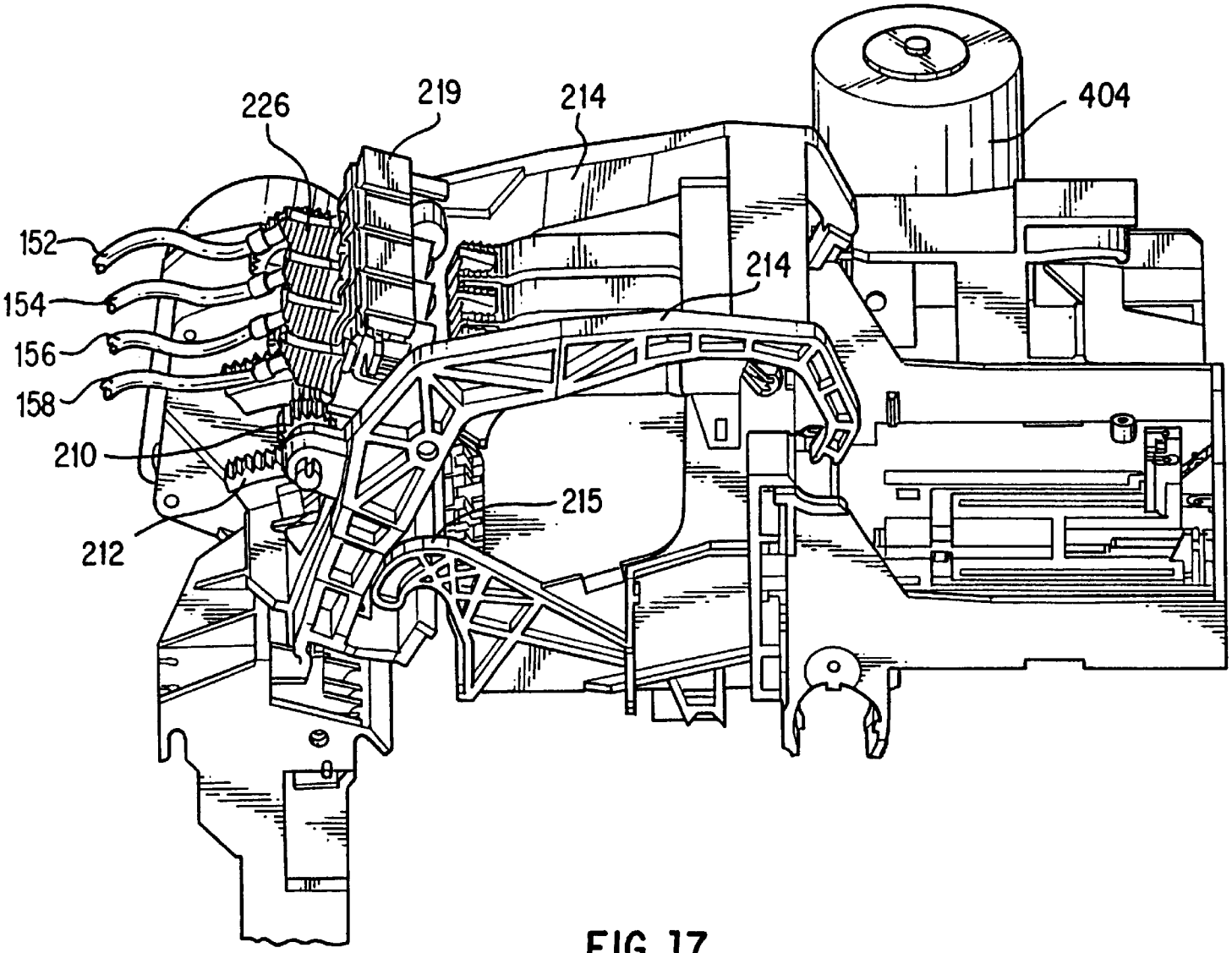
FIG. 17 shows the carriage of FIG. 16 in position at the refill station, with the valve structure in disengaged position.

As best shown in FIG. 16, the present invention does not require the specifications of the carriage to be redesigned due to the drag and interference that results from typical off-carriage ink systems where ink supply tubes remain constantly connected with the cartridges on the carriage during a printing operation. In contrast, the carriage shown in the drawings can move back and forth across the print zone without any supply tube connection whatsoever. Moreover, there is no need to account for the additional carriage mass that typically results from having a replaceable supplemental ink supply mounted directly on the carriage.

Additional details of the apparatus which provides the periodic connection/disconnection at the refill station between the print cartridge fill port and the off-carriage ink supply valve will now be described. Referring to FIGS. 9, 12–13 and 17, a bracket holding the ink supply valves supports the motor 200 which turns gears 210 to move gear arms 212 back and forth between a position of engagement of the supply valves with their respective fill ports on the print cartridges, and a position of disengagement. Primary stabilizing arms 214 on the bracket as well as secondary stabilizing arms 215 on the carriage provide the necessary restraint required to minimize an undue stress on the cartridges which might otherwise displace their precise positioning in the carriage. The beginning and end points of the engagement/disengagement are defined by an optical sensor 216.

In the presently preferred embodiment of the invention, all four ink supply valves move together as a unit as they are held in fixed position in their apertures 218 by individual locking buttons 219 that allow each valve to be separately replaced whenever the expected life of the integrated IDS has expired for that particular color of ink. When replacement is required, an arrow-shaped orientation key 222 mates with a matching orientation slot 224 by easy manual manipulation through a valve handle 226.

Figure 14A:
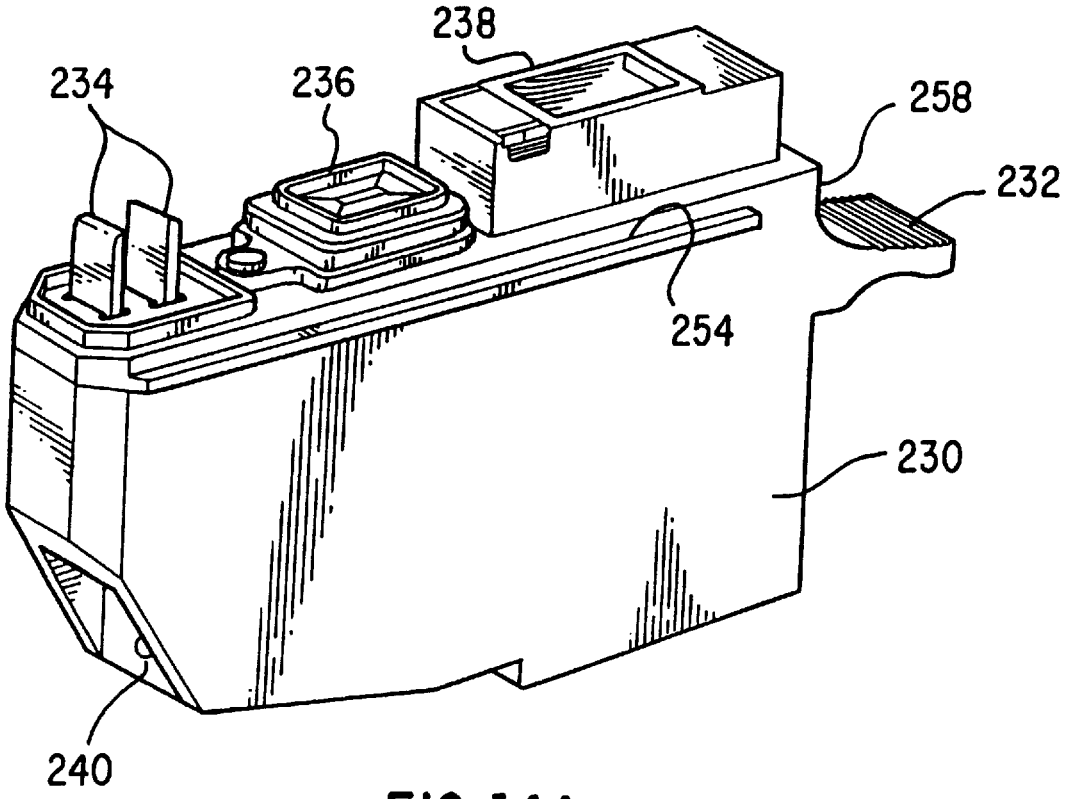
FIGS. 14A and 14B show an isometric and a side view, respectively of a service station module incorporating the present invention.
Figure 14B:
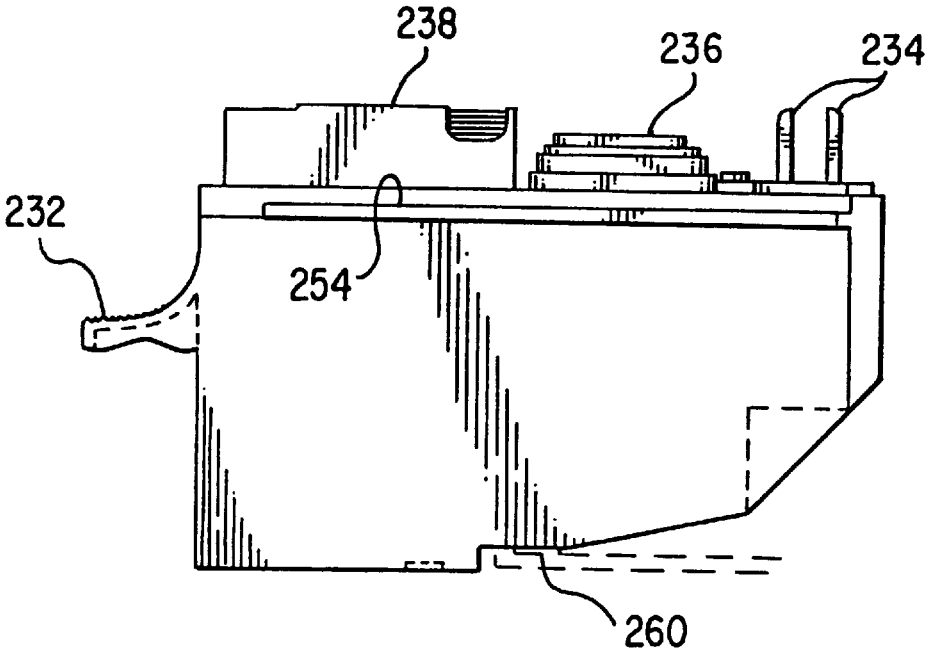
Figure 15:
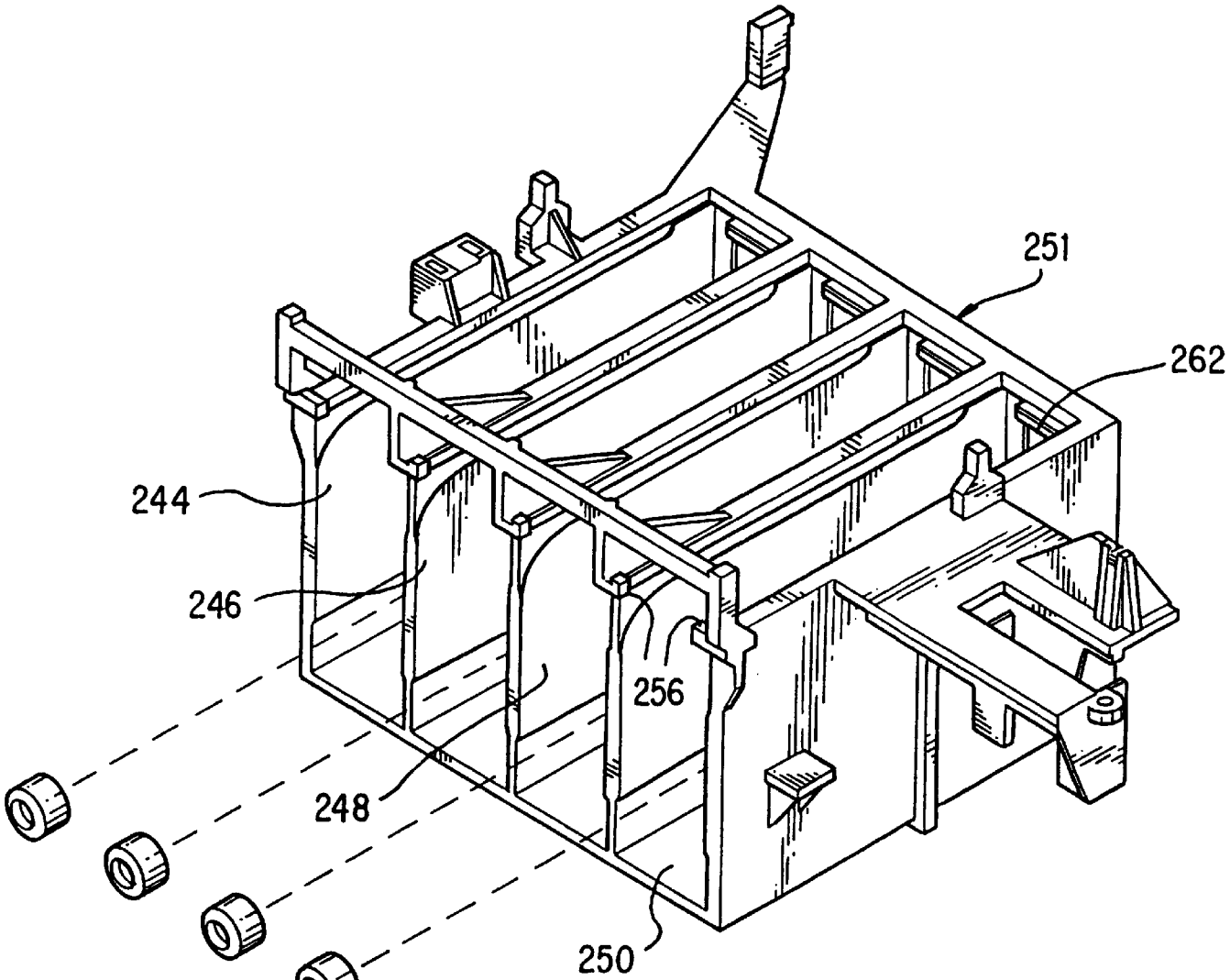
FIG. 15 is an isometric view of a carriage for removably mounting the service station module of FIGS. 14A–14B.

A unique narrowreplaceable service station module 230 for each color ink is an important part of the IDS. Referring to FIGS. 14A–14B and 15, this service station module includes a protruding handle 232 on one end, and a group of printhead servicing components which are combined together in a relatively small area on top of the module. At one end are dual wipers 234 and at the other a spittoon 238 with a nozzle plate cap 236 at an intermediate position. An external primer port 240 in the module is connected through an interior passage to the cap 236, and in the opposite direction through a circular seal 242 to a vacuum source. A service station carriage 251 includes separate slots 244, 246, 248, 250 for each service station module (also sometimes called a printhead cleaner).

A spring-loaded datum system provides for the service station module to be easily but precisely positioned in the service station carriage. Along a top portion of each slot is a z-datum ridge 252 which engages a corresponding datum ledge 254 along both top edges of the module. An upwardly biased spring arm 260 assures a tight fit along these datum surfaces. A horizontal positioning is provided in each slot by a pair of protruding corners which act as latches against matching stops 258 on the module. Although not required, a biasing arm 262 may be employed in a rear wall of each slot.

Figure 10:
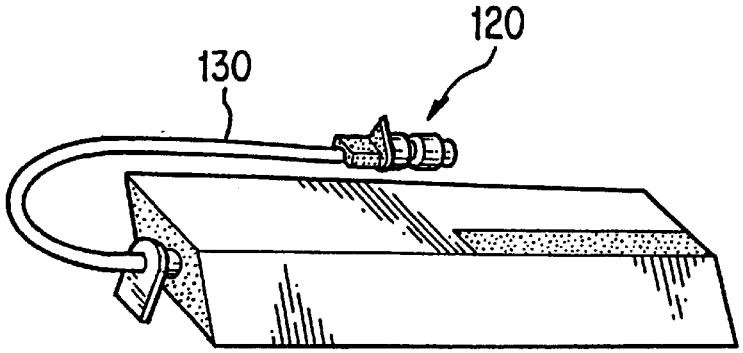
FIG. 10 shows an off-carriage ink supply module incorporating the present invention.
Figure 11:
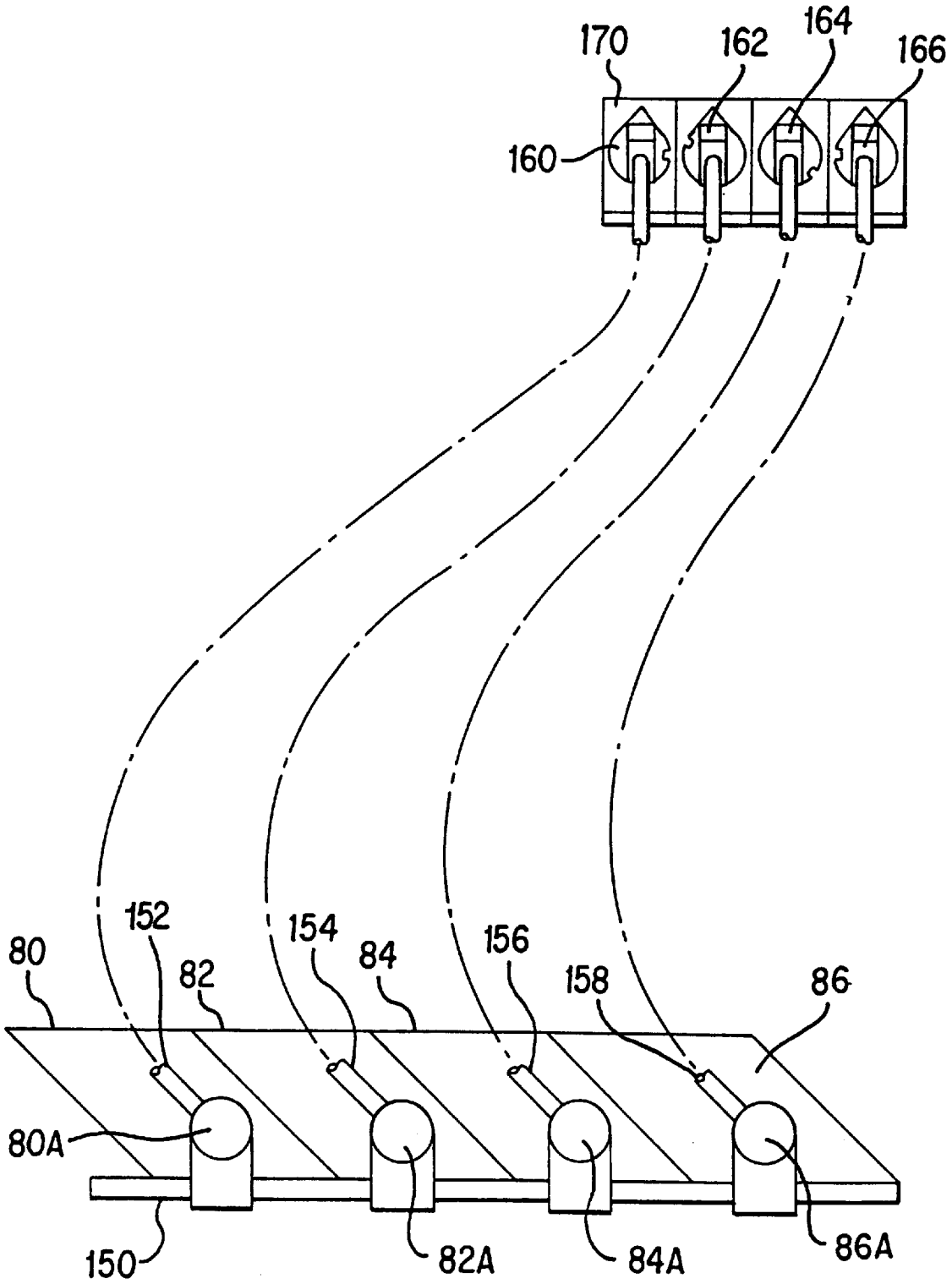
FIG. 11 is a schematic representation showing a plurality of off-carriage ink supply modules connected to the valve structure.

FIG. 10 shows the basic exterior structure of an ink supply module before installation, and FIG. 11 shows how four such modules are grouped together on a refill platform on the printer with their valves manually installed on the valve bracked.

Figure 18A:
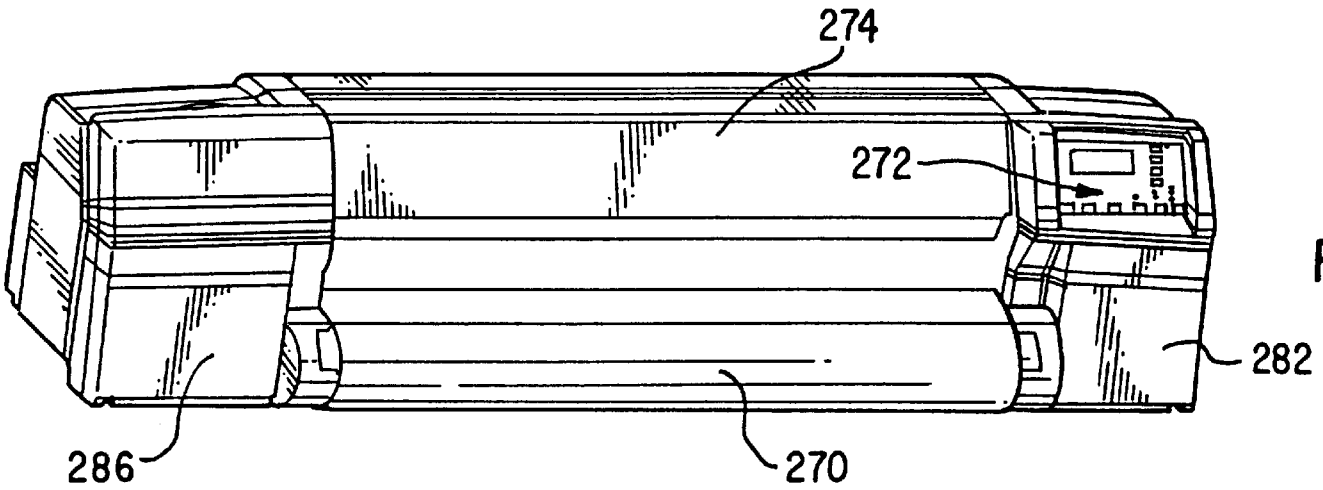
FIGS. 18A and 18B show the printer with the refill station and service station doors in closed and open positions, respectively.
Figure 18B:
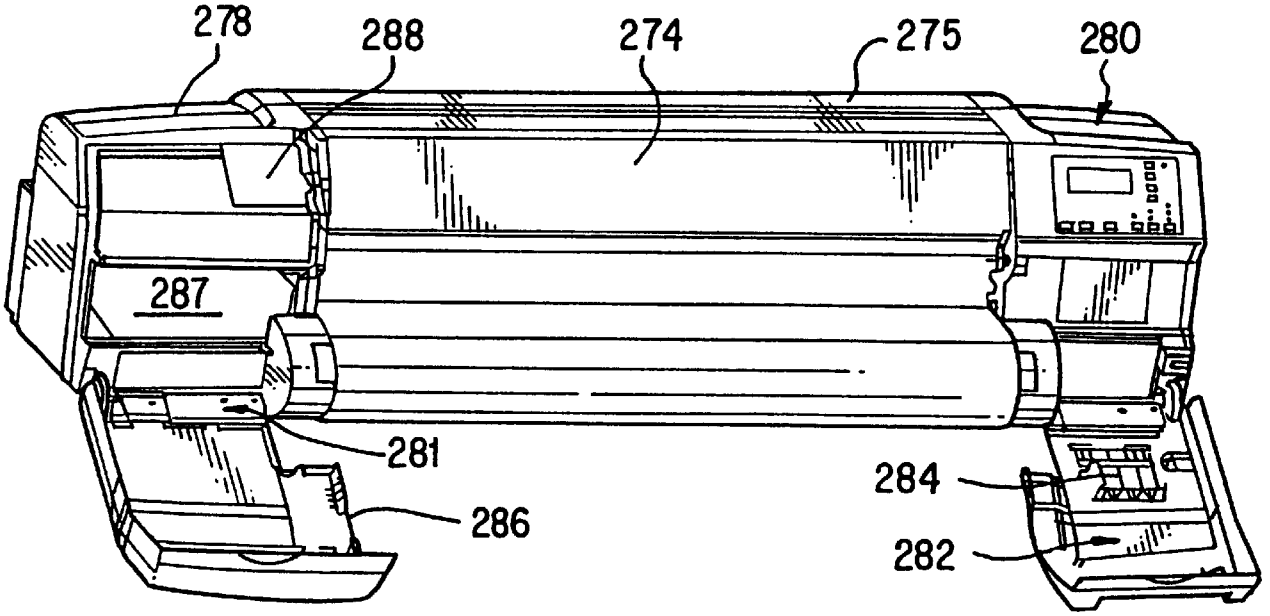
Figure 19:
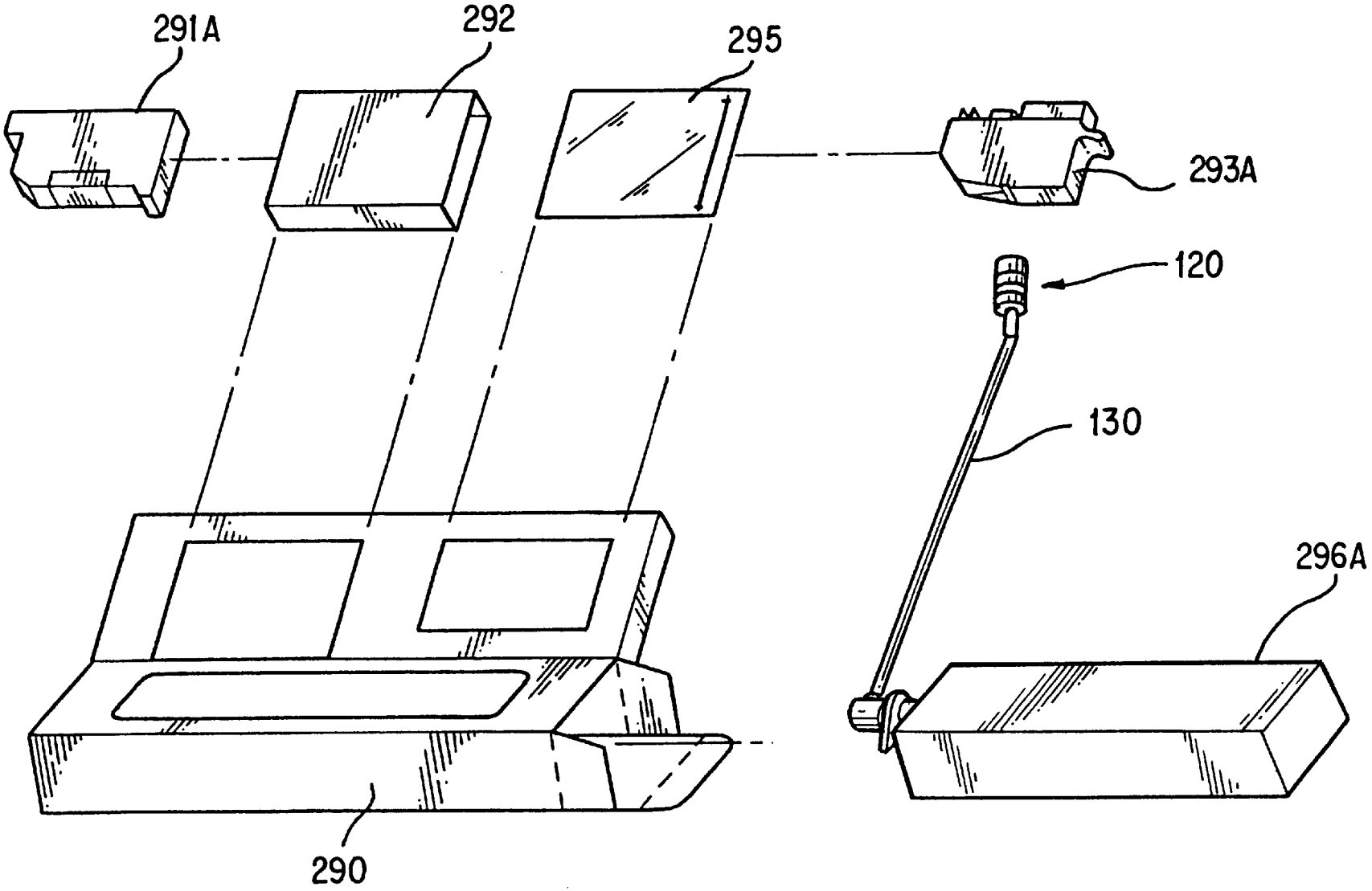
FIG. 19 in an exploded schematic view showing the integrated ink delivery system component of the invention (print cartridge, ink supply module and service station module) incorporated into a single package.
Figure 20:
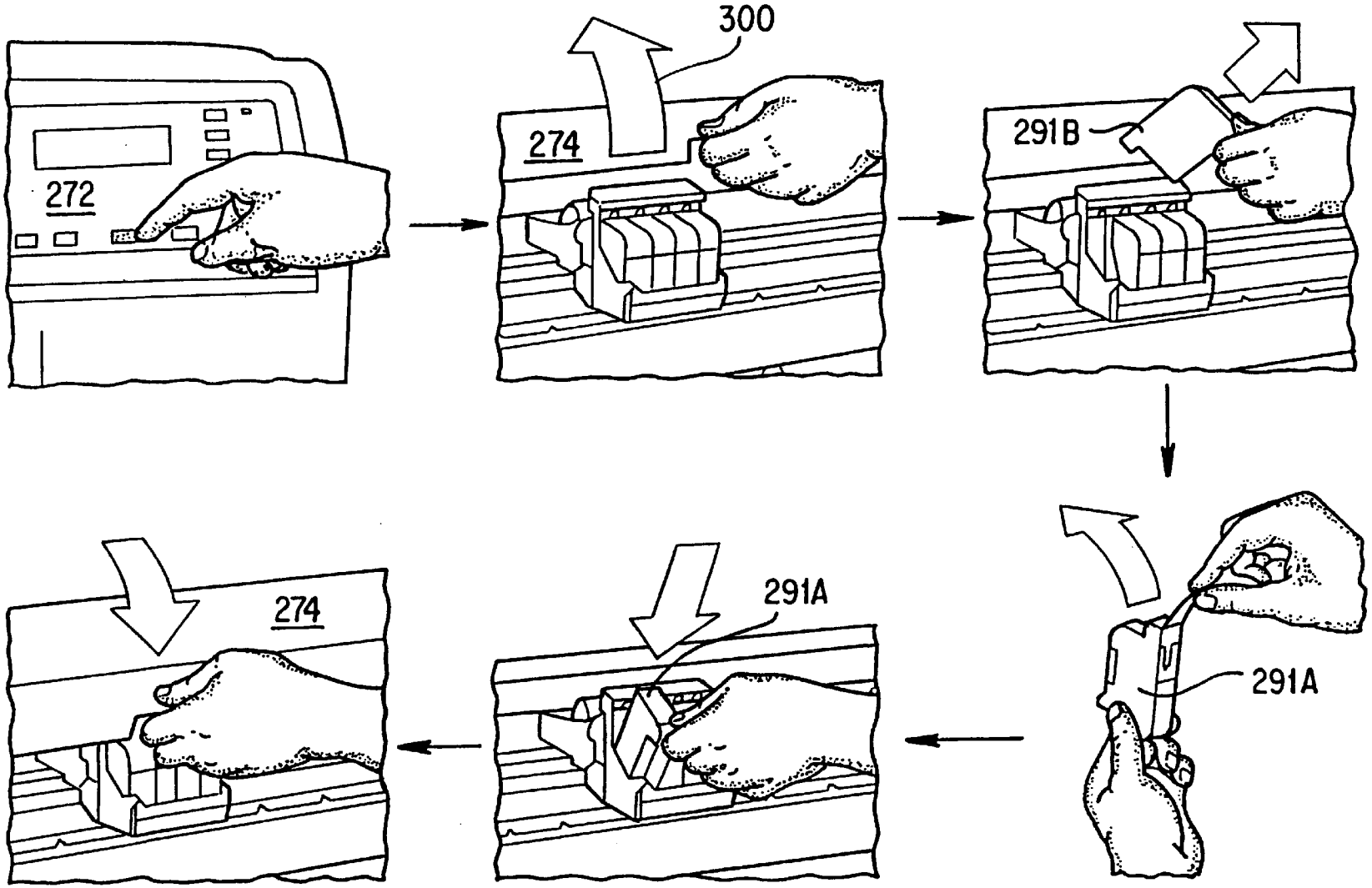
FIG. 20 shows six exemplary steps for replacing the print cartridge of the present invention.
Figure 21:
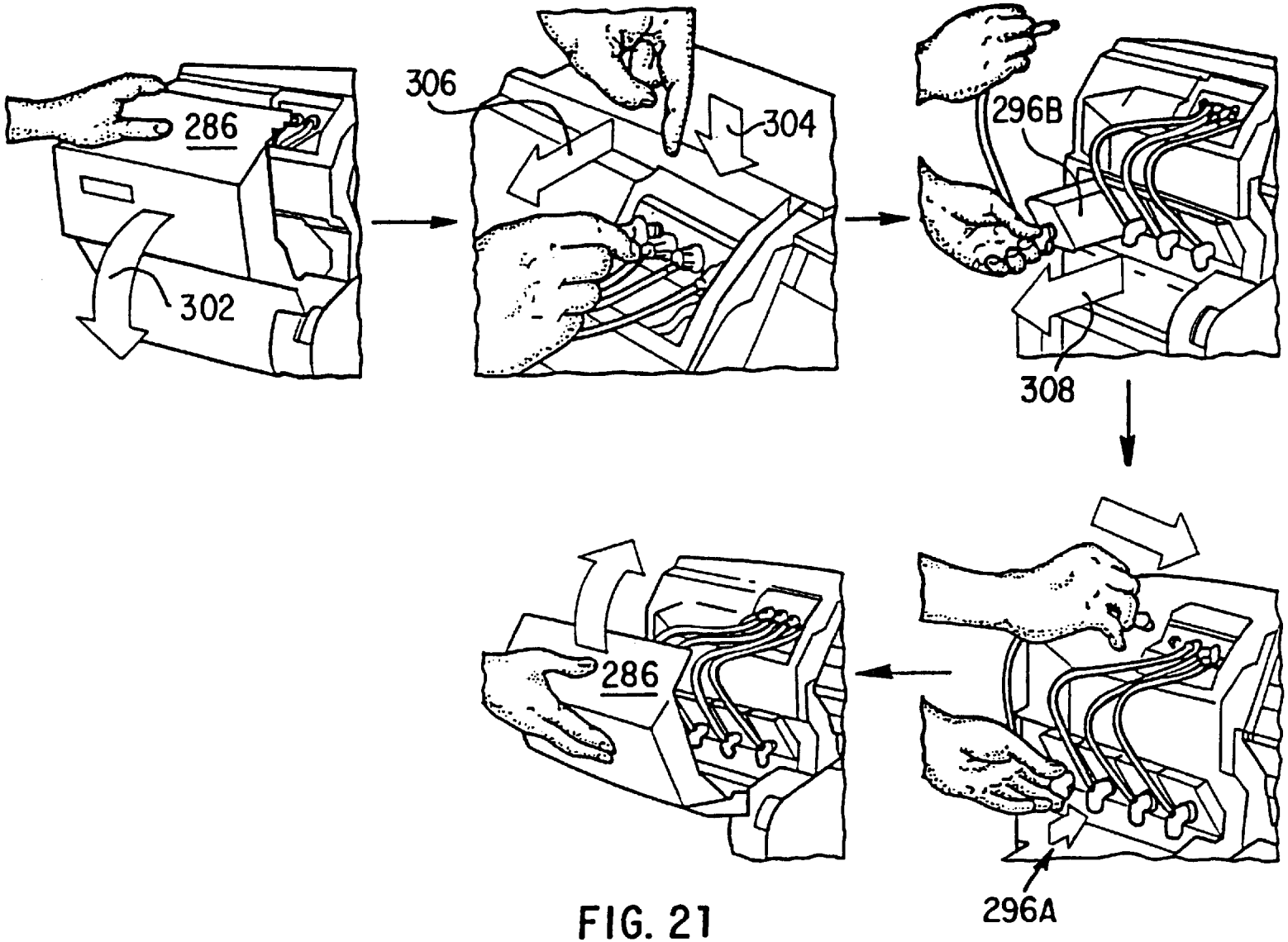
FIG. 21 shows five exemplary steps for replacing the ink supply module of the present invention.
Figure 22:
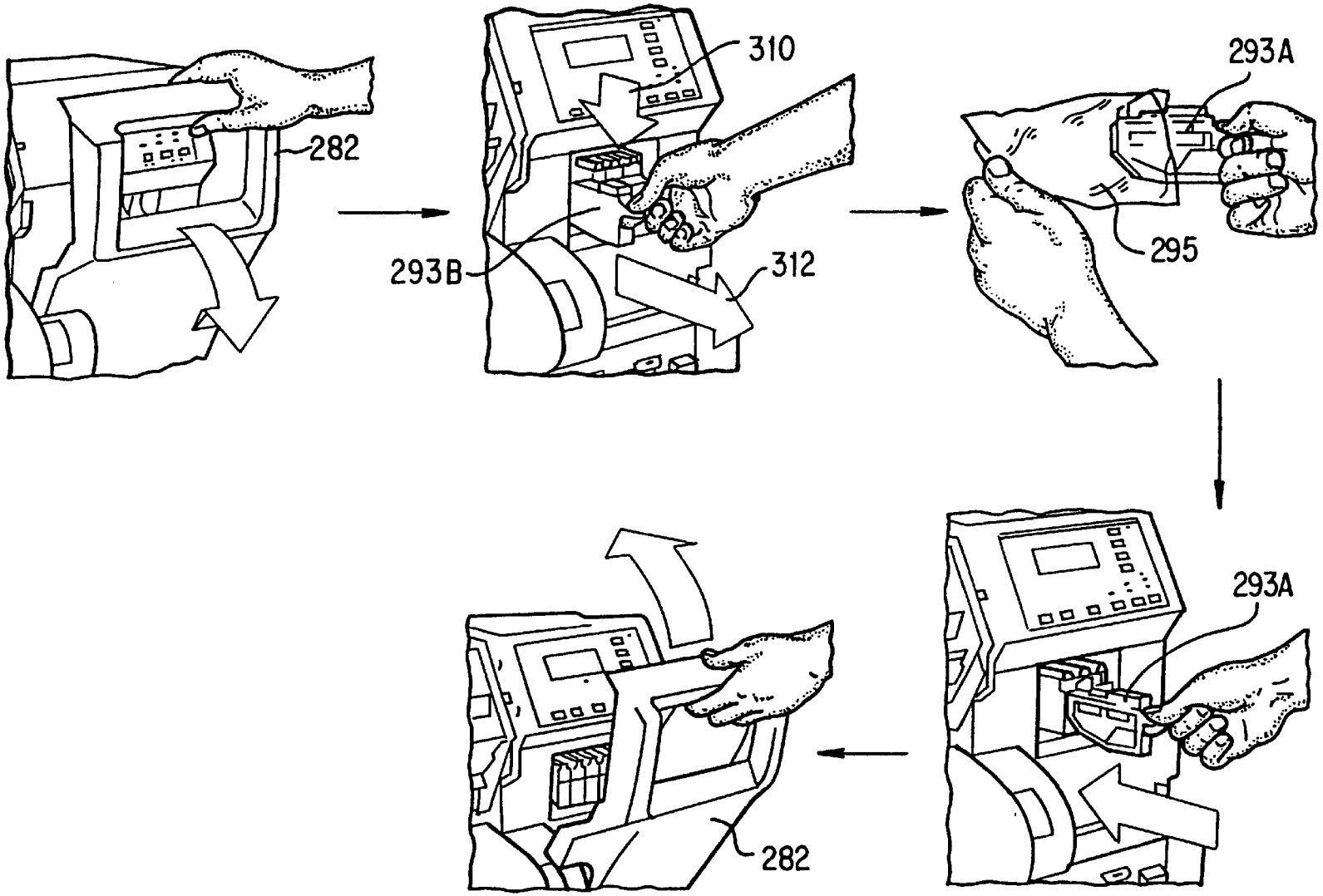
FIG. 22 shows five exemplary steps for replacing the service station module of the present invention.

FIGS. 18A and 18B illustrate the accessability required for replacement of the three basic components parts of the IDS. The front of the printer unit typically includes a roll feed unit 270, a control panel 272 and a print zone access door 274 adjacent an elongated frame member 275. The service station is located at the right end of the carriage scan axis, and a refill station 278 at the opposite end. Simple friction latches such as indicated at 280 are provided to assure proper closure of doors which a mounted on pivot hinges such as 281. A pusher plate 284 contacts and helps to position any incompletely mounted service station access modules upon closure of a service station door 282. A similar door 286 closes off the refill station during normal operation of the printer. The refill station includes space 287 for an ink supply platform, and an access hole 288 from the platform to carriage-mounted printheads.

An installation procedure will now be described in conjunction with FIGS. 19–22. An ink delivery system is preferably packaged as a unit in a carton 290 which holds a new print cartridge 291A, a new service station module 293A in a plastic storage bag 295, and a new ink supply module 296A. As shown in the self-explanatory sequence of drawings of FIG. 20, an old print cartridge 291B is easily removed and replaced with a new one 291A, after actuating a button on the control panel 272 and opening the print zone access door 274 as shown by arrow 300. As shown in the self-explanatory sequence of drawings of FIG. 21, a depleted ink supply module 296B is removed without difficulty by first opening the ink door 286 as shown by arrow 302, then pushing down on the lock button as shown by arrow 304 and at the same time pulling out the valve as shown by arrow 306 and then removing the ink supply module 293B from the printer as shown by arrow 308. The depleted ink module 296B can then be replaced with a new ink supply module 296A and then the ink door 26 is closed. Finally as shown in the self-explanatory sequence of drawings of FIG. 22, after the service station access door 282 is opened a user can push down on the handle in the direction shown by arrow 310 thereby dislodging an old service station module 293B, and then pull it out all the way as indicated by arrow 312, followed by installation of a new service station module 293A.

Accordingly it will be appreciated by those skilled in the art that the basic features of the unique take-a-gulp ink replenishment system of the present invention provides a unique but relatively simple way of providing for unattended printing through automated ink replenishment. Furthermore, all ink-related components can he replaced for a particularly color of ink by a user, without the need of special tools and without the need calling a specialized service person.

While a preferred embodiment of the invention has been shown and described, it will be appreciated by those skilled in the art the various modifications can be made without departing from the spirit and scope of the invention as defined by the following claims.

We claim as our invention:

1. An inkjet printing system having a printhead mounted on a carriage, with an inlet port on the printhead for replenishment of a negative-pressure ink reservoir associated with the printhead when the carriage is in a stationary resting position, comprising:

a control valve adapted for engagement with the inlet port on the printhead, said valve having an open state permitting ink flow through said valve and a closed state precluding ink flow through the valve;

a supply of ink located off the carriage and in fluid communication with said valve;

a bracket for holding said valve in a passive position separated from the printhead;

a mechanism operatively connected to said bracket to move said valve from said passive position to an active position engaged with the inlet port on the printhead to allow replenishment of the ink reservoir from said supply of ink without removing the printhead from the carriage.

2. The printing system of claim 1 which further includes:

a storage container for said supply of ink; and a tube connected between said storage container and said valve.

3. The printing system of claim 2 wherein said valve is an on/off valve which is normally in said closed state when said valve is in said passive position to prevent said supply of ink from being dispensed from said storage container.

4. The printing system of claim 3 wherein said valve is in said open state when said valve is in said active position to allow said supply of ink to be dispensed from said storage container into the ink reservoir.

5. The printing system of claim 2 wherein said tube between said storage container and said valve remains unobstructed when said valve is in said passive position.

6. The printing system of claim 2 wherein said tube between said storage container and said valve remains unobstructed when said valve is in said active position.

7. The printing system of claim 1 wherein said mechanism further moves said valve from said passive position to said active position.

8. The printing system of claim 7 wherein said valve automatically changes from said closed state to said open state when said mechanism moves said valve from said passive position to said active position.

9. The printing system of claim 1 wherein said mechanism further moves said valve from said active position to said passive position.

10. The printing system of claim 9 wherein said valve automatically changes from said open state to said closed state when said mechanism moves said valve from said active position to said passive position.

11. The printing system of claim 1 wherein said bracket includes attachment means for removably mounting said valve on said bracket.

12. The printing system of claim 1 which further includes a printer frame for supporting said supply of ink.

13. The system of claim 1 further including:

a plurality of printheads mounted on the carriage, each printhead including an associated ink reservoir and an inlet port for replenishment of the associated ink reservoir, the reservoirs for the plurality of printheads for holding different colors of ink;

a corresponding plurality of said control valves each for engagement with a corresponding inlet port of one of said printheads; and a corresponding plurality of supplies of ink of different colors located off the carriage and in fluid communication with a corresponding one of said control valves.

14. The system of claim 13 wherein said bracket for holding said plurality of control valves in said passive position separated from the printheads, and said mechanism collectively moves the plurality of control valves to an active position into engagement with corresponding inlet ports at said printheads to allow simultaneous replenishment of said plurality of associated ink reservoirs from said supplies of ink without removing said printheads from said carriage.

15. A method of inkjet printing using at least one printhead with an associated reservoir mounted on a carriage in a printer, without having to replace the printhead when the associated reservoir on the carriage is depleted, comprising the following steps:

providing a supply of ink located off the carriage;

providing the at least one printhead with a normally closed inlet port which is accessible when the at least one printhead is mounted on the carriage;

connecting the supply of ink with a control valve;

mounting the control valve on a bracket located on the printer;

maintaining the control valve to be normally closed;

positioning the carriage in a stationary position without removing the at least one printhead from the carriage;

moving the control valve into a position of engagement with the inlet port; and changing the control valve from closed to open to allow replenishment of the associated ink reservoir from the supply of ink.

16. The method of claim 15 wherein said providing step includes providing the at least one printhead with an associated negative pressure reservoir.

17. A method of ink replenishment in an inkjet printer by providing ink through an on/off valve to a printhead mounted on a printer carriage without removing the printhead from the carriage, the on/off valve moves periodically from a passive position of separation from the printhead to an active position of engagement with an inlet port of a negative pressure ink reservoir associated with the printhead, comprising the following steps:

filling a container with a supply of ink;

positioning the container in a location off the carriage;

connecting the container to the on/off valve through a supply tube;

maintaining the on/off valve in a closed position to prevent dispensing the supply of ink from the container when the on/off valve is in the passive position of separation from the printhead;

moving the carriage to a service location where the carriage can remain stationary; and changing the on/off valve to an open position to allow dispensing the supply of ink from the container after said moving step and when the on/off valve is in the active position of engagement with the inlet port of the printhead.

18. The method of claim 17 which further includes the step of attaching said on/off valve to a bracket on the printer, and wherein said changing step includes moving the bracket toward the printhead.

19. The method of claim 18 wherein said changing step is actuated non-manually by a motorized mechanism.

20. The method of claim 18 wherein said changing step is accomplished by the engagement of the on/off valve with the inlet port of the printhead.

21. The method of claim 17 wherein said positioning step includes positioning the container on the printer.

22. The method of claim 17 which further includes the step of sealing the container and the supply tube to prevent any intrusion of air.

* * * * *